US008032364B1

(12) United States Patent
Watts

(10) Patent No.: US 8,032,364 B1
(45) Date of Patent: Oct. 4, 2011

(54) DISTORTION MEASUREMENT FOR NOISE SUPPRESSION SYSTEM

(75) Inventor: Lloyd Watts, Mountain View, CA (US)

(73) Assignee: Audience, Inc., Mountain View, CA (US)

( * ) Notice: Subject to any disclaimer, the term of this patent is extended or adjusted under 35 U.S.C. 154(b) by 0 days.

(21) Appl. No.: 13/016,916

(22) Filed: Jan. 28, 2011

Related U.S. Application Data

(63) Continuation of application No. 12/944,659, filed on Nov. 11, 2010.

(60) Provisional application No. 61/296,436, filed on Jan. 19, 2010.

(51) Int. Cl.
*G10L 21/02* (2006.01)

(52) U.S. Cl. ..... 704/226; 704/233

(58) Field of Classification Search ..... 704/226, 704/233

See application file for complete search history.

(56) References Cited

U.S. PATENT DOCUMENTS

| | | | | |
|---|---|---|---|---|
| 6,526,140 | B1 | 2/2003 | Marchok et al. | |
| 6,804,651 | B2 | 10/2004 | Juric et al. | |
| 7,289,955 | B2 | 10/2007 | Deng et al. | |
| 7,327,985 | B2 | 2/2008 | Morfitt, III et al. | |
| 7,376,558 | B2 | 5/2008 | Gemello et al. | |
| 7,383,179 | B2 | 6/2008 | Alves et al. | |
| 7,657,038 | B2 | 2/2010 | Doclo et al. | |
| 7,725,314 | B2 | 5/2010 | Wu et al. | |
| 7,895,036 | B2 * | 2/2011 | Hetherington et al. | 704/233 |
| 2002/0156624 | A1 * | 10/2002 | Gigi | 704/226 |
| 2003/0040908 | A1 * | 2/2003 | Yang et al. | 704/233 |
| 2005/0114128 | A1 * | 5/2005 | Hetherington et al. | 704/233 |
| 2007/0027685 | A1 | 2/2007 | Arakawa et al. | |
| 2008/0059163 | A1 | 3/2008 | Ding et al. | |
| 2009/0012783 | A1 | 1/2009 | Klein | |
| 2009/0220107 | A1 | 9/2009 | Every et al. | |
| 2009/0323982 | A1 | 12/2009 | Solbach et al. | |
| 2010/0138220 | A1 | 6/2010 | Matsumoto et al. | |

FOREIGN PATENT DOCUMENTS

JP 2008015443 A 1/2008

OTHER PUBLICATIONS

Kato, et al. "Noise Suppression with High Speech Quality Based on Weighted Noise Estimation and MMSE STSA" Proc. IWAENC [Online] 2001, pp. 183-186.

Soon, et al. "Low Distortion Speech Enhancement" Proc. Inst. Elect. Eng. [Online] 2000, vol. 147, pp. 247-253.

* cited by examiner

*Primary Examiner* — Abul K Azad
(74) *Attorney, Agent, or Firm* — Carr & Ferrell LLP

(57) ABSTRACT

The present technology measures distortion introduced by a noise suppression system. The distortion may be measured as the difference between a noise-reduced speech signal and an estimated idealized noise reduced reference (EINRR). The EINRR may be determined from a speech component and noise component that are pre-processed, and the EINRR may be used with masks associated with energies lost and added in the speech component and noise component. The EINRR may be calculated on a time varying basis.

8 Claims, 9 Drawing Sheets

DISTORTION MEASUREMENT FOR NOISE SUPPRESSION SYSTEM

CROSS-REFERENCE TO RELATED APPLICATION

This application is a continuation of and claims the priority and benefit of U.S. patent application Ser. No. 12/944,659, filed Nov. 11, 2010, and entitled "Noise Distortion Measurement by Noise Suppression Processing," which claims the priority and benefit of U.S. Provisional Patent Application Ser. No. 61/296,436, filed Jan. 19, 2010, and entitled "Noise Distortion Measurement by Noise Suppression Processing." The disclosures of the aforementioned patent applications are incorporated herein by reference.

BACKGROUND OF THE INVENTION

Mobile devices such as cellular phones typically receive an audio signal having a speech component and a noise component when used in most environments. Methods exist for processing the audio signal to identify and reduce a noise component within the audio signal. Sometimes, noise reduction techniques introduce distortion into the speech component of an audio signal. This distortion causes the desired speech signal to sound muffled and unnatural to a listener.

Currently, there is no way to identify the level of distortion created by a noise suppression system. The ITU-T G.160 standard teaches how to objectively measure Noise Suppression performance (SNRI, TNLR, DSN), and explicitly indicates that it does not measure Voice Quality or Voice Distortion. ITU-T P.835 subjectively measures Voice Quality with a Mean Opinion Score (MOS), but since the measure requires a survey of human listeners, the method is inefficient, expensive, time-consuming, and expensive. P.862 (PESQ) and various related tools attempt to automatically predict MOS scores, but only in the absence of noise and noise suppressors.

SUMMARY OF THE INVENTION

The present technology measures distortion introduced by a noise suppression system. The distortion may be measured as the difference between a noise reduced speech signal and an estimated idealized noise reduced reference. The estimated idealized noise reduced reference (EINRR) may be calculated on a time varying basis.

The technology may make a series of recordings of the inputs and outputs of a noise suppression algorithm, create an EINRR, and analyze and compare the recordings and the EINRR in the frequency domain (which can be, for example, Short Term Fourier Transform, Fast Fourier Transform, Cochlea model, Gammatone filterbank, sub-band filters, wavelet filterbank, Modulated Complex Lapped Transforms, or any other frequency domain method). The process may allocate energy in time-frequency cells to four components: Voice Distortion Lost Energy, Voice Distortion Added Energy, Noise Distortion Lost Energy, and Noise Distortion Added Energy. These components can be aggregated to obtain Voice Distortion Total Energy and Noise Distortion Total Energy.

An embodiment for measuring distortion in a signal may be performed by constructing an estimated idealized noise reduced reference from a noise component and a speech component. At least one of a voice energy added, voice energy lost, noise energy added, and noise energy lost in a noise suppressed audio signal may be calculated. The audio signal may be generated from the noise component and the speech component. The calculation may be based on the estimated idealized noise reduced reference. The estimated idealized noise reduced reference is constructed from a speech gain estimate and a noise reduction gain estimate. The speech gain estimate and noise reduction gain estimate may be time and frequency dependent.

DESCRIPTION OF EXEMPLARY EMBODIMENTS

The present technology measures distortion introduced by a noise suppression system. The distortion may be measured as the difference between a noise reduced speech signal and an estimated idealized noise reduced reference. The estimated idealized noise reduced reference (EINRR) may be calculated on a time varying basis. The present technology generates the EINRR and analyzes and compares the recordings and the EINRR in the frequency domain (which can be, for example, Short Term Fourier Transform, Fast Fourier Transform, Cochlea model, Gammatone filterbank, sub-band filters, wavelet filterbank, Modulated Complex Lapped Transforms, or any other frequency domain method). The process may allocate energy in time-frequency cells to four components: Voice Distortion Lost Energy, Voice Distortion Added Energy, Noise Distortion Lost Energy, and Noise Distortion Added Energy. These components can be aggregated to obtain Voice Distortion Total Energy and Noise Distortion Total Energy.

Figure 1A:
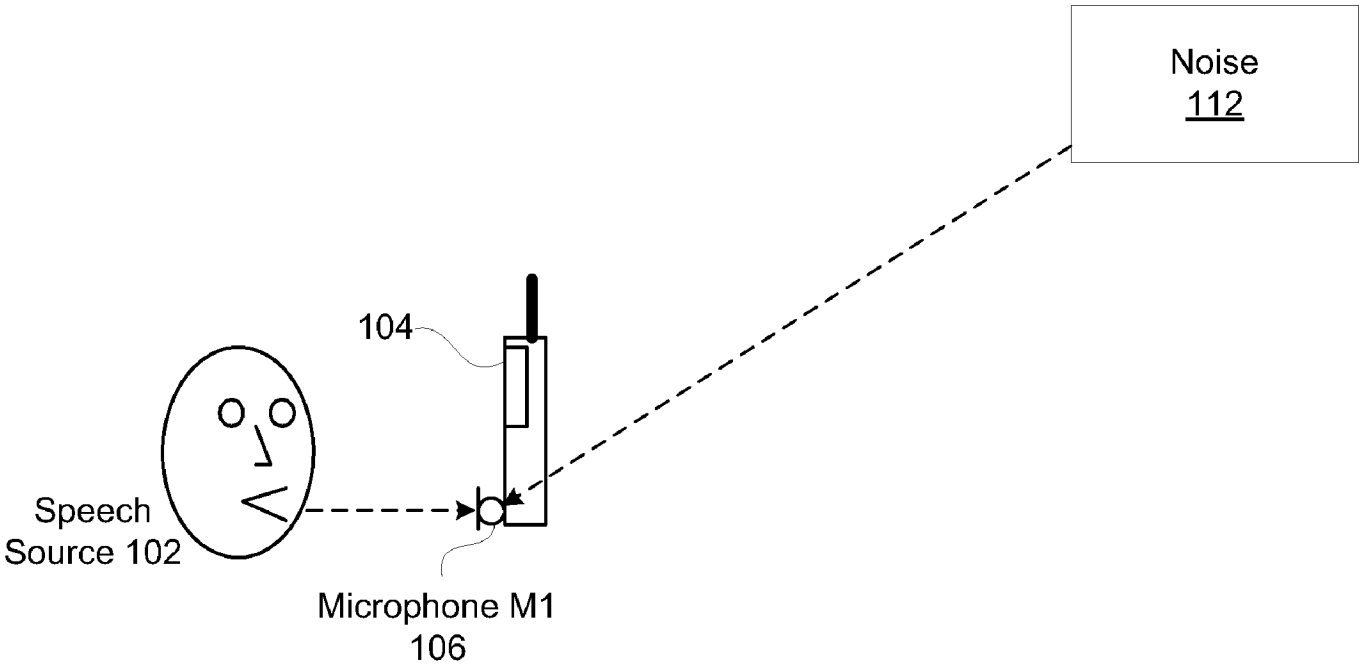
FIG. 1A is a block diagram of an exemplary environment having speech and noise captured by a mobile device.

The present technology may be used to measure distortion introduced by a noise suppression system, such as for example a noise suppression system within a mobile device. FIG. 1A is a block diagram of an exemplary environment having speech and noise captured by a mobile device. A speech source 102, such as a user of a cellular phone, may speak into mobile device 104. A user provides an audio (speech) source 102 to a communication device 104. The communication device 104 may include one or more microphones, such as primary microphone (M1) 106 relative to the audio source 102. The primary microphone may provide a primary audio signal. If present, an additional microphone may provide a secondary audio signal. In exemplary embodiments, the one or more microphones may be omni-directional microphones. Alternative embodiments may utilize other forms of microphones or acoustic sensors.

Each microphone may receive sound information from the speech source 102 and noise 112. While the noise 112 is shown coming from a single location, the noise may comprise any sounds from one or more locations different than the speech and may include reverberations and echoes.

Noise reduction techniques may be applied to an audio signal received by microphone 106 (as well as additional audio signals received by additional microphones) to determine a speech component and noise component and to reduce the noise component in the signal. Typically, distortion is introduced into a speech component (such as from speech source 102) of the primary audio signal by performing noise reduction on the primary audio signal. Identifying a noise component and speech component and performing noise reduction in an audio signal is described in U.S. patent application Ser. No. 12/215,980, entitled "System and Method for Providing Noise Suppression Utilizing Null Processing Noise Subtraction," filed Jun. 30, 2008, the disclosure of which is incorporated herein by reference. The present technology may be used to measure the level of distortion introduced into a primary audio signal by a noise reduction technique.

Figure 1B:
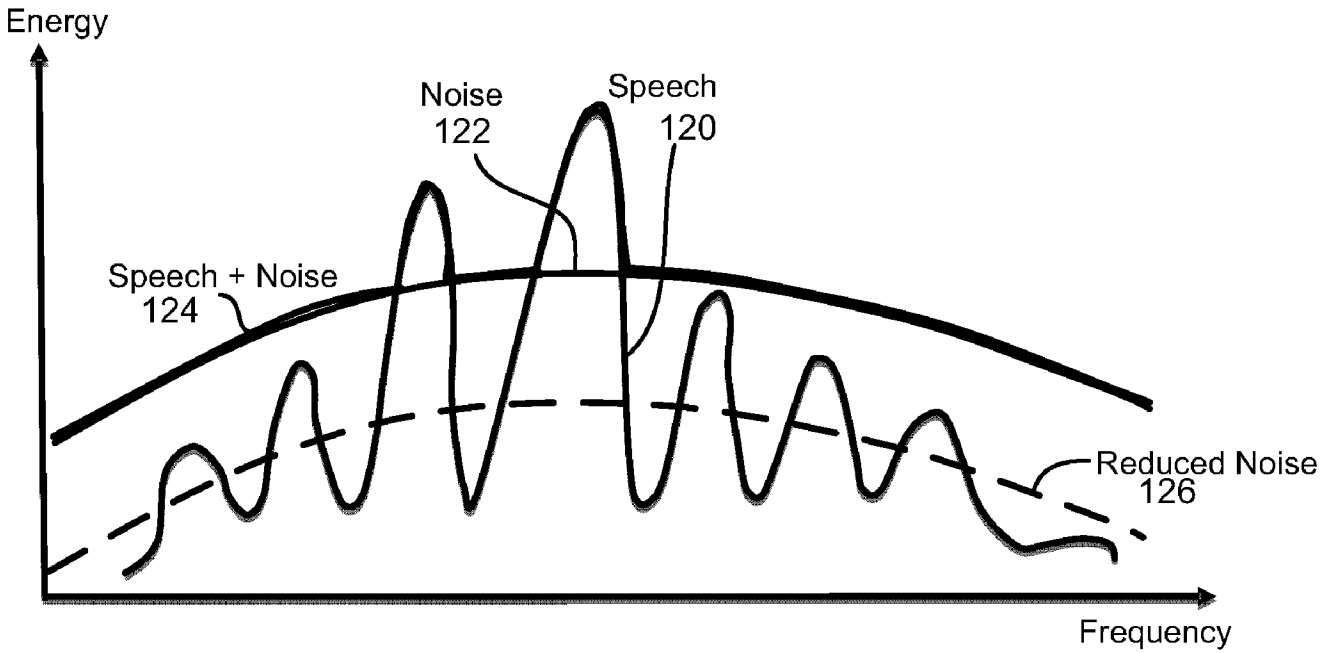
FIGS. 1B-1D illustrates speech and noise signal plots of frequency versus energy.
Figure 1C:
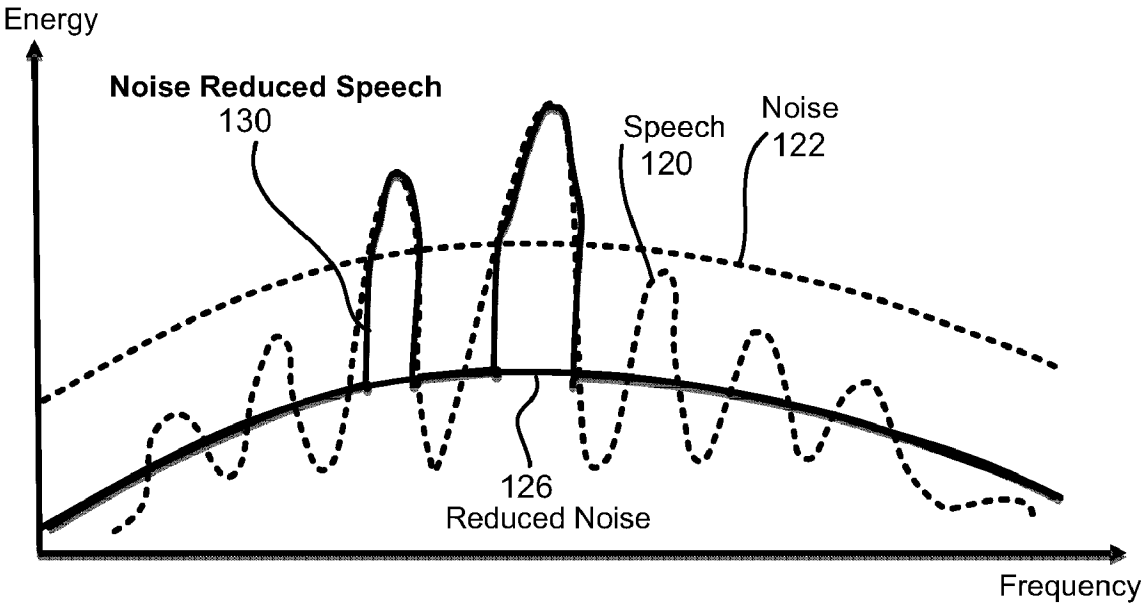
Figure 1D:
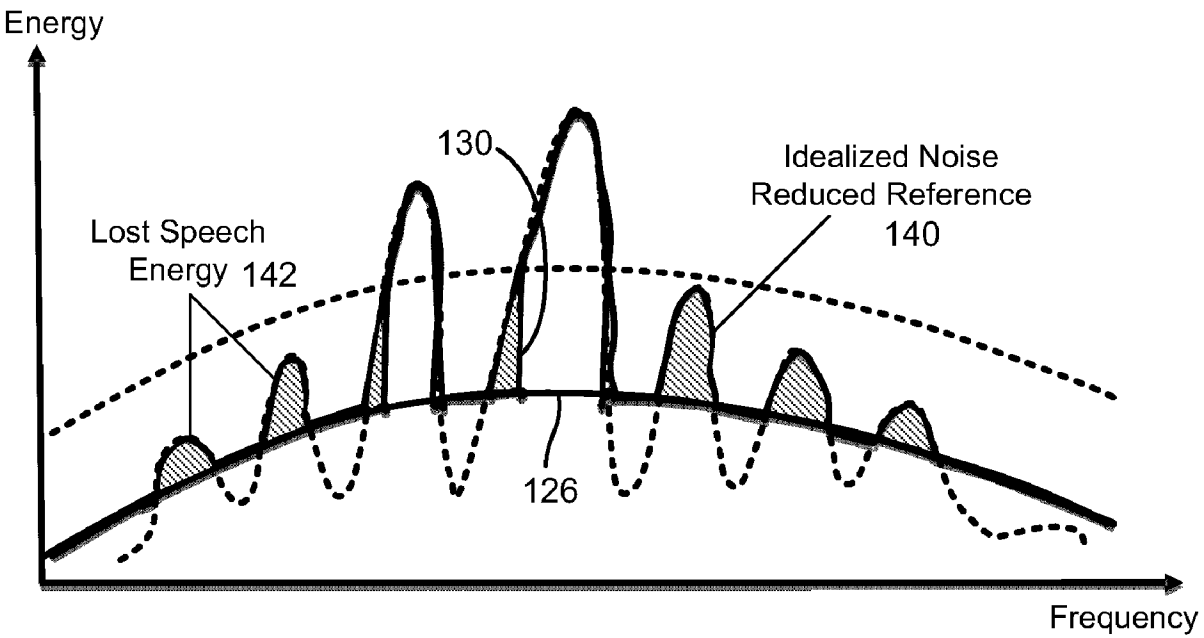

FIGS. 1B-1D illustrate exemplary portions of a noise signal and speech signal at a particular point in time, such as during a frame of a primary audio signal received through microphone 106.

FIG. 1B illustrates exemplary speech signal 120 and a noise signal 122 in a plot of energy versus frequency. The speech signal and noise signal may comprise the audio signal received at microphone 105 in FIG. 1. Portions of speech signal 120 have energy peaks greater than the energy of noise signal 122. Other portions of speech signal 120 have energy levels below the energy level of noise signal 122. Hence, the resulting signal heard by a listener is the combination of the speech (at points with higher energy than noise) and noise signals, as indicated by the speech plus noise signal 124.

In order to reduce speech, noise reduction systems may process speech and noise components of an audio signal to reduce the noise energy to a reduced noise signal 126. Ideally, the noise signal 122 would be reduced to reduced noise level 126 without affecting the speech energy levels both greater and less than the energy level of noise signal 122. However, this is usually not the case, and speech signal energy is lost as a result of noise reduction processing.

FIG. 1C illustrates a noise-reduced speech noise signal 130. As shown, the noise level has been reduced from previous noise level 122 to a reduced noise level of 126. However, energy associated with several peaks in the speech signal 120, peaks where with energy levels less than noise level 122, have been removed by the noise reduction processing. In particular, only the peaks which had energies higher than original noise signal 122 exist in the noise reduced speech signal 130. The energy for speech signal peaks less than the energy of noise level 122 has been lost due to noise reduction processing of the combined speech and noise signal.

FIG. 1D illustrates an idealized noise reduced reference signal 140. As indicated, when a noise level is reduced from a first noise energy 122 to a second level noise energy 126, it would be desirable to maintain the energy contained in the speech signal which is higher energy than noise level 126 (in FIG. 1B) but less than noise level 122. The idealized noise reduced reference signal 140 indicates the ideal noise reduced reference which captures these peak energies. In real systems, the speech signal energy which is less than the noise signal energy 122 is lost during noise reduction processing, and therefore contributes to distortion as introduced by noise reduction. The shaded regions of FIG. 1C indicate lost speech energy 142 resulting from noise suppression processing of a speech and noise signal 124.

Figure 2:
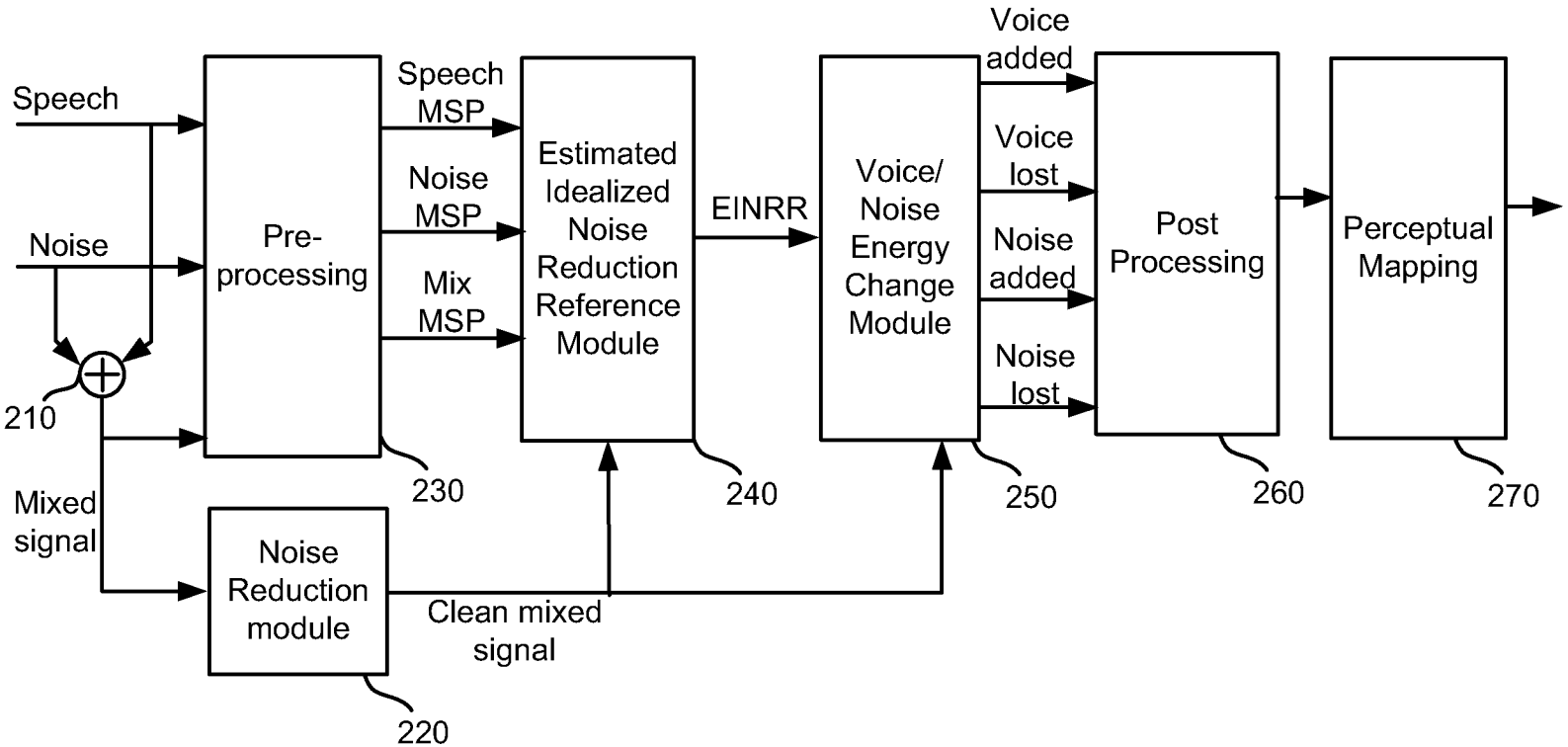
FIG. 2 is a block diagram of an exemplary system for measuring distortion in a noise suppression system.

FIG. 2 is a block diagram of an exemplary system for measuring distortion in a noise suppression system. The system of FIG. 2 includes pre-processing block 230, noise reduction module 220, estimated idealized noise reduced reference (EINRR) module 240, voice/noise energy change module 250, post-processing module 260 and perceptual mapping module 270.

The system of FIG. 2 measures the distortion introduced into a primary microphone speech signal by noise reduction module 220. Noise reduction module 220 may receive a mixed signal containing a speech component and a noise component and provides a clean mixed signal. In practice, noise reduction module 220 may be implemented in a mobile device such as a cellular phone.

Blocks 230-270 are used to measure the distortion introduced by noise reduction module 220. Pre-processing block 230 may receive a speech component, noise component, and clean mixed signal. Pre-processing block 230 may process the received signals to match the noise reduction inherent framework. For example, pre-processing block 230 may filter the received signals to achieve a limited bandwidth signal (narrow band telephony band) of 200 Hz to 3600 Hz. Pre-processing block 230 may provide output of minimum signal path (MSP) speech signal, minimum signal path noise signal, and minimum signal path mixed signal.

Estimated idealized noise reduced reference (EINRR) module 240 receives the minimum signal path signals and the clean mixed signal and outputs an EINRR signal. The operation of EINRR module 240 is discussed in more detail below with respect to the methods of FIGS. 3-4.

Voice/noise energy change module 250 receives the EINRR signal and the clean mixed signal, and outputs a measure of energy lost and added for both the voice component and the noise component. The added and lost energy values are calculated by identifying speech dominance in a particular sub-band and determining the energy lost or added to the sub-band. Four masks may be generated, one each for voice energy lost, voice energy added, noise energy lost, and noise energy added. The masks are applied to the EINRR signal and the result is output to post-processing module 260. The operation of Voice/noise energy change module 250 is discussed in more detail below with respect to the methods of FIGS. 3 and 5.

Post-processing module 260 receives the masked EINRR signals representing voice and noise energy lost and added. The signals may then be processed, such as for example to perform frequency weighting. An example of frequency weighting may include weighting the frequencies which may be determined more important to speech, such as frequencies near 1 KHz, frequencies associated with constants, and other frequencies.

Perceptual mapping module 270 may receive the post-processed signal and map the output of the distortion measurements to a desired scale, such as for example a perceptually meaningful scale. The mapping may include mapping to a more uniform scale in perceptual space, mapping to a Mean Opinion Score, such as one or all of the P.835 Mean Opinion Score scales as Signal MOS, or Noise MOS. The mapping may also be performed by Overall MOS by correlating with P.835 MOS results. The output signal may provide a measurement of the distortion introduced by a noise reduction system.

Figure 3:
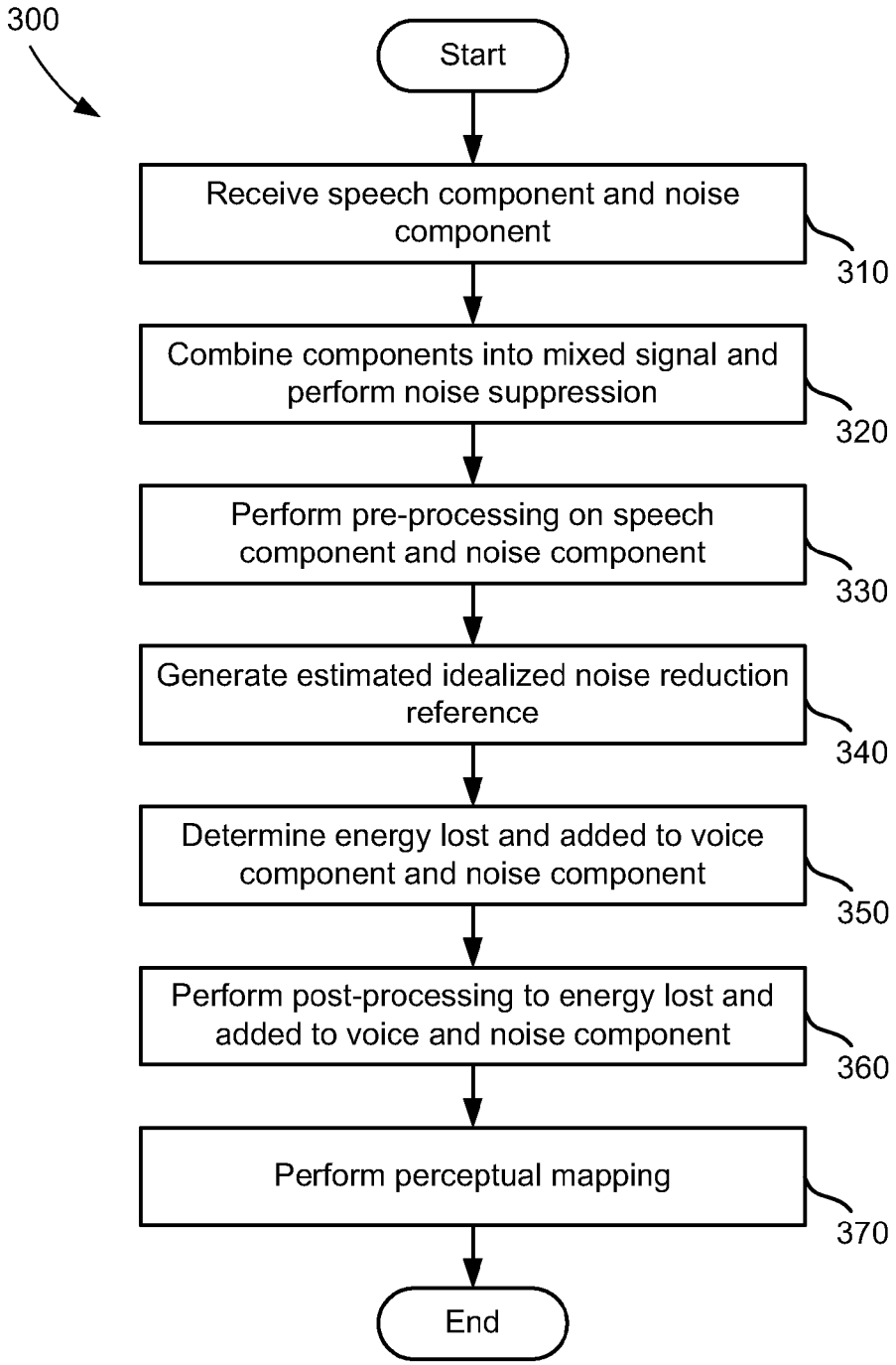
FIG. 3 is a flow chart of an exemplary method for measuring distortion in a noise suppression system.

FIG. 3 is a flow chart of an exemplary method for measuring distortion in a noise suppression system. The method of FIG. 3 may be performed by the system of FIG. 2. First, a speech component and noise component are received at step 310. The speech component and noise component may be determined by an audio signal processing system such as that described in U.S. patent application Ser. No. 11/343,524 entitled "System and Method for Utilizing Inter-Level Differences for Speech Enhancement," filed Jan. 30, 2006, the disclosure of which is incorporated herein by reference.

Mixer 210 may receive and combine the speech component and noise component to generate a mixed signal at step 320. The mixed signal may be provided to noise reduction module 220 and pre-processing block 230. Noise reduction module 220 suppresses a noise component in the mixed signal but may distort a speech component while suppressing noise in the mixed signal. Noise reduction module 220 outputs a clean mixed signal which is noise-reduced but typically distorted.

Pre-processing may be performed at step 330. Pre-processing block 230 may preprocess a speech component and noise component to match inherent framework processing performed in noise reduction module 220. For example, the pre-processing block may filter the speech component and noise component, as well as the mixed signal provided by adder 210, to get a limited bandwidth. For example, limited bandwidth may be a narrow telephony band of 200 hertz to 3,600 hertz. Pre-processing may include performing pre-distortion processing on the received speech and noise components by applying a gain to higher frequencies within the noise component and the speech component. Pre-processing block outputs minimum signal path (MSP) signals for each of the speech component, noise component and the mixed signal component.

An estimated idealized noise reduced reference signal is generated at step 340. EINRR module 240 receives the speech MSP, noise MSP, and mixed MSP from pre-processing block 230. EINRRM module 240 also receives the clean mixed signal provided by noise reduction module 220. The received signals are processed to provide an estimated idealized noise reduced reference signal. The EINRR is determined by estimating the speech gain and the noise reduction performed to the mixed signal by noise reduction module 220. The gains are applied to the corresponding original signals and the gained signals are combined to determine the EINRR signal. The gains may be determined on a time varying basis, for example at each frame processed by the EINRR module. Generation of the EINRR signal is discussed in more detail below with respect to the methods of FIGS. 3 and 4.

The energy lost and added to a speech component and noise component are determined at step 350. Voice/noise energy change module 250 receives the EINRR signal from module 240, the clean mixed signal from noise reduction module 220, the speech component, and the noise component. Voice/noise energy change module 250 outputs a measure of energy lost and added for both the voice component and the noise component. Operation of voice/noise energy change module 280 is discussed below with respect to the methods of FIGS. 3 and 5.

Post-processing is performed at step 360. Post-processing module 260 receives a voice energy added signal, voice energy lost signal, noise energy added signal, and noise energy lost signal from module 250 and performs post-processing on these signals. The post-processing may include perceptual frequency weighting on one or more frequencies of each signal. For example, portions of certain frequencies may be weighted differently than other frequencies. Frequency weighting may include weighting frequencies near 1 KHz, frequencies associated with speech constants, and other frequencies. The distortion value is then provided from post-processing module 260 to perceptual mapping block 270.

Perceptual mapping block 270 may map the output of the distortion measurements to a perceptually meaningful scale at step 370. The mapping may include mapping to a more uniform scale in perceptual space, mapping to a mean opinion score (MOS), such as one or all of the P.835 mean opinion score scales as signal MOS, noise MOS, or overall MOS. Overall MOS may be performed by correlating with P.835 MOS results.

Figure 4:
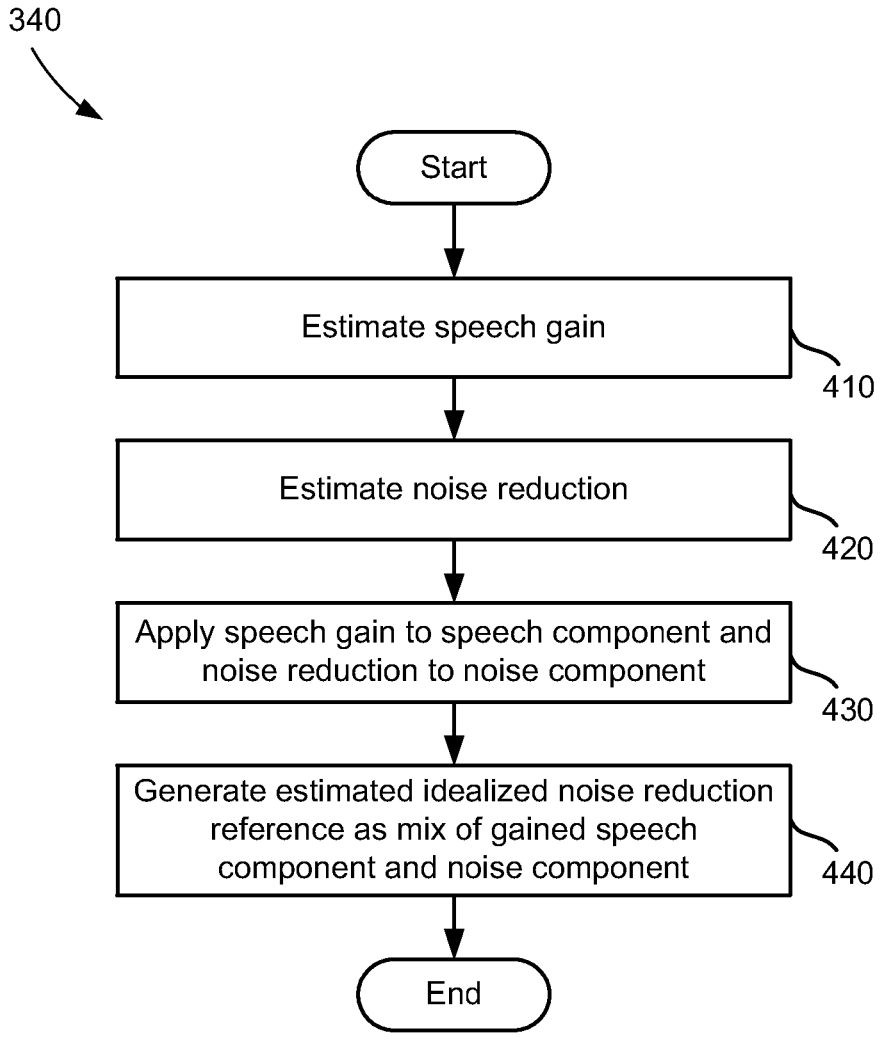
FIG. 4 is a flow chart of an exemplary method for generating an estimated idealized noise reduced reference.

FIG. 4 is a flow chart of an exemplary method for generating an estimated idealized noise reduced reference. The method of FIG. 4 may provide more detail for step 340 of the method of FIG. 3 and may be performed by EINRR module 240.

A speech gain is estimated at step 410. The speech gain is the gain applied to speech by noise reduction module 220 and may be estimated or determined in any of several ways. For example, the speech gain may be estimated by first identifying a portion of the current frame this is dominated by speech energy as opposed to noise energy. The portion of the frame may be a particular frequency or frequency band at which speech energy which is greater than noise energy. For example, in FIG. 1B, the speech energy is greater than the noise energy at two frequencies. A speech dominated band or frequency may be determined by speech dominance detection. For example, one or more frequencies with a particular frame where the speech dominates the noise may be determined by comparing a speech component and noise component for a particular frame. Other methods may also be used to determine speech gain applied by noise reduction module 220.

Once speech dominant frequencies are identified, the speech energy at that frequency before noise reduction is performed may be compared to the speech energy in the clean mixed signal. The ratio of the original speech energy to the clean speech energy may be used as the estimated speech gain.

A level of noise reduction for a frame is estimated at step 420. The noise reduction is the level of reduction (e.g., gain) in noise applied by noise reduction module 220. Noise reduction can be estimated by identifying a portion in a frame, such as a frequency or frequency band, which is dominated by noise. Hence, a frame may be identified in which a user is not talking. This may be determined, for example, by detecting a pause or reduction in the energy level of the received speech signal. Once such a portion in the signal is identified, the ratio of the energy in the noise component prior to noise reduction processing may be compared to the clean mixed signal energy provided by noise reduction module 220. The ratio of the noise energies may be used as the noise reduction at step 420.

The speech gain may be applied to the speech component and the noise reduction may be applied to the noise component at step 430. For example, the speech gain determined at step 410 is applied to the speech component received at step 310. Similarly, the noise reduction level determined at step 420 is applied to the noise component received at step 310.

The estimated idealized noise reduced reference is generated at step 440 as a mix of the speech signal and noise signal generated at step 430. Hence, the two signals generated at step 430 are combined to estimate the idealized noise reduced reference signal.

In some embodiments, the method of FIG. 4 is performed in a time varying manner. Hence, the speech gain at step 410 and the noise reduction calculation at step 420 may be performed on an ongoing basis, such as once per frame, rather than being estimated only once for the entire analysis.

Figure 5:
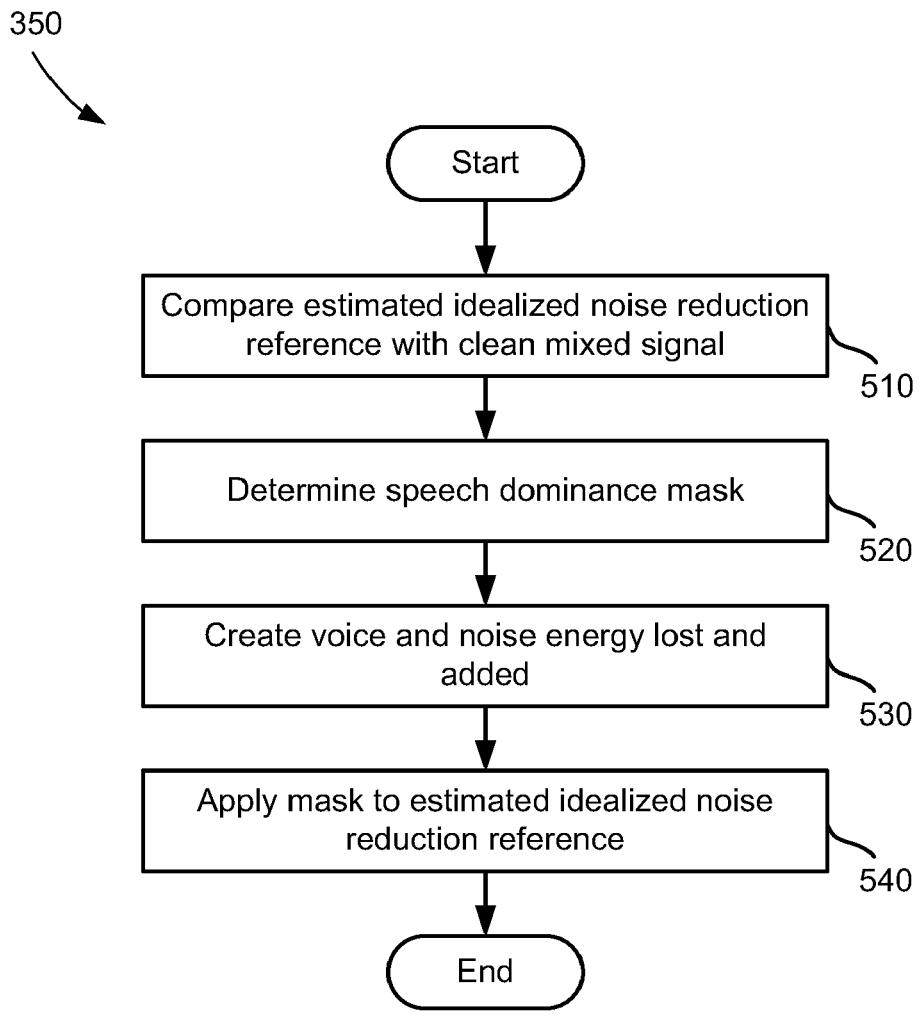
FIG. 5 is a flow chart of an exemplary method for determining energy lost and added to a voice component and noise component.

FIG. 5 is a flow chart of an exemplary method for determining energy lost and added to a voice component and a noise component. In some embodiments, the method of FIG. 5 provides more detail for step 350 of the method of FIG. 3 and is performed by voice/noise energy change module 250. First, an estimated idealized noise reduced reference signal is compared with a clean mixed signal at step 510. The signals are compared to determine the energy added or lost by the noise reduction module 220 in the method of FIG. 2. This energy added or lost is the distortion introduced by the noise reduction module 220 which is being used to determine the distortion.

A speech dominance mask is determined at step 520. The speech dominance mask may be calculated by identifying the time-frequency cells in which the speech signal is larger than the residual noise in the EINRR.

Voice and noise energy lost and added is determined at step 530. Using the speech dominance mask determined at step 520, and the estimated idealized noise reduced reference signal and the clean signal provided by noise reduction module 220, the voice energy lost and added and the noise energy lost and added are determined.

Each of the four masks is applied to the estimated idealize noise reduced reference signal at step 540. Each mask is applied to get the energy for each corresponding portion (noise energy lost, noise energy added, speech energy lost, and speech energy added). The result of applying the masks is then added together to determine the distortion introduced by the noise reduction module 220.

The above-described modules may be comprised of instructions that are stored in storage media such as a machine readable medium (e.g., a computer readable medium). The instructions may be retrieved and executed by the processor 302. Some examples of instructions include software, program code, and firmware. Some examples of storage media comprise memory devices and integrated circuits. The instructions are operational when executed by the processor 302 to direct the processor 302 to operate in accordance with embodiments of the present technology. Those skilled in the art are familiar with instructions, processors, and storage media.

Figure 6:
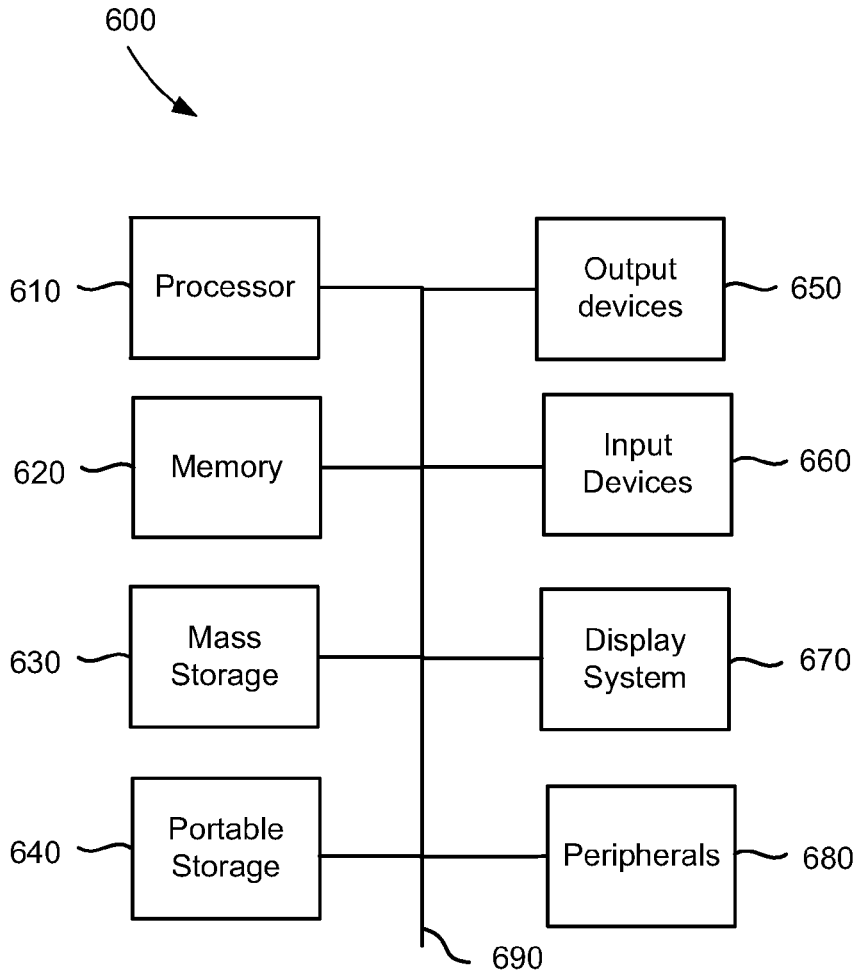
FIG. 6 illustrates an exemplary computing system 600 that may be used to implement an embodiment of the present technology.

FIG. 6 illustrates an exemplary computing system 600 that may be used to implement an embodiment of the present technology. System 600 of FIG. 6 may be implemented to execute a software program implementing the modules illustrated in FIG. 2. The computing system 600 of FIG. 6 includes one or more processors 610 and memory 610. Main memory 610 stores, in part, instructions and data for execution by processor 610. Main memory 610 can store the executable code when in operation. The system 600 of FIG. 6 further includes a mass storage device 630, portable storage medium drive(s) 640, output devices 650, user input devices 660, a graphics display 670, and peripheral devices 680.

The components shown in FIG. 6 are depicted as being connected via a single bus 690. The components may be connected through one or more data transport means. Processor unit 610 and main memory 610 may be connected via a local microprocessor bus, and the mass storage device 630, peripheral device(s) 680, portable storage device 640, and display system 670 may be connected via one or more input/output (I/O) buses.

Mass storage device 630, which may be implemented with a magnetic disk drive or an optical disk drive, is a non-volatile storage device for storing data and instructions for use by processor unit 610. Mass storage device 630 can store the system software for implementing embodiments of the present technology for purposes of loading that software into main memory 610.

Portable storage device 640 operates in conjunction with a portable non-volatile storage medium, such as a floppy disk, compact disk or Digital video disc, to input and output data and code to and from the computer system 600 of FIG. 6. The system software for implementing embodiments of the present technology may be stored on such a portable medium and input to the computer system 600 via the portable storage device 640.

Input devices 660 provide a portion of a user interface. Input devices 660 may include an alpha-numeric keypad, such as a keyboard, for inputting alpha-numeric and other information, or a pointing device, such as a mouse, a trackball, stylus, or cursor direction keys. Additionally, the system 600 as shown in FIG. 6 includes output devices 650. Suitable output devices include speakers, printers, network interfaces, and monitors.

Display system 670 may include a liquid crystal display (LCD) or other suitable display device. Display system 670 receives textual and graphical information, and processes the information for output to the display device.

Peripherals 680 may include any type of computer support device to add additional functionality to the computer system. Peripheral device(s) 680 may include a modem or a router.

The components contained in the computer system 600 of FIG. 6 are those typically found in computer systems that may be suitable for use with embodiments of the present technology and are intended to represent a broad category of such computer components that are well known in the art. Thus, the computer system 600 of FIG. 6 can be a personal computer, hand held computing device, telephone, mobile computing device, workstation, server, minicomputer, mainframe computer, or any other computing device. The computer can also include different bus configurations, networked platforms, multi-processor platforms, etc. Various operating systems can be used including Unix, Linux, Windows, Macintosh OS, Palm OS, and other suitable operating systems.

The present technology is described above with reference to exemplary embodiments. It will be apparent to those skilled in the art that various modifications may be made and other embodiments may be used without departing from the broader scope of the present technology. For example, the functionality of a module discussed may be performed in separate modules, and separately discussed modules may be combined into a single module. Additional modules may be incorporated into the present technology to implement the features discussed as well variations of the features and functionality within the spirit and scope of the present technology. Therefore, there and other variations upon the exemplary embodiments are intended to be covered by the present technology.

What is claimed is:

1. A method for measuring distortion in a noise-reduced signal, comprising:

receiving a noise component which does not contain speech;

receiving a speech component which does not contain noise;

receiving a combined signal by a noise reduction module, the combined signal formed from the combination of the noise component and the speech component;

generating a noise reduced signal by the noise reduction module, the noise reduction module performing noise reduction to the combined signal to generate the noise reduced signal;

constructing an estimated idealized noise reduced reference from the noise component, the speech component and the noise-reduced signal; and comparing the noise-reduced signal and the estimated idealized noise reduced reference to calculate a measure of distortion produced by the noise reduction module, the distortion calculated as at least one of the voice energy added, voice energy lost, noise energy added, and noise energy lost in the noise-reduced signal.

2. The method of claim 1, wherein the estimated idealized noise reduced reference is constructed from a speech gain estimate and noise reduction gain estimate that are time variant.

3. The method of claim 1, further comprising applying a bandwidth limited gain to the speech signal and the noise signal before constructing an estimated idealized noise reduced reference.

4. The method of claim 1, further comprising applying a frequency weighted gain to the at least one of the voice energy added, voice energy lost, noise energy added, and noise energy lost.

5. The method of claim 1, wherein constructing includes applying an estimated speech gain to the speech component.

6. The method of claim 1, wherein constructing includes applying an estimated noise reduction gain to the noise component.

7. The method of claim 1, wherein calculating includes:

creating a mask for the at least one of the voice energy added, voice energy lost, noise energy added, and noise energy lost; and combining the difference of the mask and the estimated idealized noise reduced reference.

8. The method of claim 1, further comprising mapping the at least one of the voice energy added, voice energy lost, noise energy added, and noise energy lost in the noise-reduced signal to a predicted speech quality mean opinion score.

* * * * *